US005100348A

United States Patent [19]

Herman et al.

[11] Patent Number: 5,100,348

[45] Date of Patent: Mar. 31, 1992

[54] ELECTRICAL DISTRIBUTOR

[75] Inventors: Rodney A. Herman, Alemeda; Donald E. Angel, Jr., Oakland, both of Calif.

[73] Assignee: Monster Cable Products, Inc., South San Francisco, Calif.

[21] Appl. No.: 687,382

[22] Filed: Apr. 18, 1991

Related U.S. Application Data

[63] Continuation of Ser. No. 502,103, Mar. 29, 1990, abandoned.

[51] Int. Cl.[5] ..... H01R 4/38

[52] U.S. Cl. ..... 439/724; 439/798; 439/805

[58] Field of Search ..... 439/723, 724, 798, 805; 174/945

[56] References Cited

U.S. PATENT DOCUMENTS

| | | | |
|---|---|---|---|
| 902,235 | 10/1908 | Kellner | 439/805 |
| 2,001,131 | 5/1935 | Guhl | 439/805 |
| 2,718,626 | 9/1955 | Benander | 439/724 |
| 4,050,770 | 9/1977 | Rigo | 439/724 |
| 4,148,546 | 4/1979 | Wilson, Jr. et al. | 439/724 |
| 4,728,304 | 3/1988 | Fischer | 439/857 |

FOREIGN PATENT DOCUMENTS

| | | | |
|---|---|---|---|
| 551633 | 4/1923 | France | 439/798 |

*Primary Examiner*—Gary F. Paumen

*Attorney, Agent, or Firm*—Rosen, Dainow & Jacobs

[57] ABSTRACT

An electrical distributor including a conductive base unit having a first surface and a first hole extending into the first surface, the first hole having a threaded end adjacent the first surface, and an inwardly tapered portion spaced from the first surface, a compressible conductive sleeve having a central hole and one conical end, the sleeve being fitted into the first hole with the conical end thereof abutting the tapered portion of the first hole, and a bolt threaded in the first hole and for urging the sleeve against the tapered portion and thereby compressing the sleeve, whereby a conductor extending into the first hole and sleeve may be held therein by compressing of the sleeve.

10 Claims, 3 Drawing Sheets

ELECTRICAL DISTRIBUTOR

This is a continuation division of application of Ser. No. 07/502,103, filed Mar. 29, 1990, now abandoned.

BACKGROUND OF THE INVENTION

1. Field of the Invention

This invention relates to a power distribution system. More particularly this invention relates to high power distribution systems for motor vehicles. The distribution system is for distributing power from a battery supply to any number of peripheral electrical devices in the vehicle such as a radio, windows, locks, lighter etc.

2. Description of the Art

The prior art includes an elongated conductive piece of metal with holes in it for receiving conductors such as connectors, wire terminals or wire cables. The conductors are often multi-stranded or braided wires and are secured into the conductive piece of metal with simply a screw pressing the conductor against a side of the conductive metal. Such elongated pieces of metal are usually not insulated. Thus the conductors and the conductive metal are exposed to all types of harsh and corrosive elements that quickly weaken the connections. The system is not safe from flying sparks and is a constant fire hazard. Furthertmore, the screwing in of a pointed screw against a stranded metal conductor constantly wears and frays the conductor so that the connection is always weak and eventually the connection is completely cut off. There is also risk of damage to the elongated conductive piece of metal itself from the pointed screw end being screwed into it constantly.

Another example of the prior art is a round washer shaped terminal end. The round conductive end extends from an electric supply and is for receiving and feeding all other conductors. The other conductors are piled on top of each other and screwed onto the terminal end. If there is a problem with a connection all of the conductors have to be unloaded, tested and reconnected in order to find the weak link.

Furthermore, since the conductors are all piled on one another, the risk of corrosion multiplies. If one corroded conductor is in contact with the rest, in a short time they will all become corroded. Since there is no protection from outside elements, the distribution system experiences constant build up of grime, such as grease, oil and dirt. The grime makes it hard to detect and repair poor connections. In fact, the harsh environment increases the risk of poor connections, as well as burdens the repair of such.

Other forms of connectors employ plugs with friction fits. The friction fit plugs easily vibrate loose in a motor vehicle or moving appliance as well as suffer from the same enviromental problems as above.

There are other variations of such power distribution systems but none that completely insulate both the conductors and the conductive base unit. None of the other power distributor systems ensure a contact that will continually give a good electrical connection without damaging the conductor. Certainly, no electrical distribution system is aesthetically pleasing for a show car look.

SUMMARY AND OBJECTS OF THE INVENTION

Accordingly it is an object of the present invention to provide an electrical distribution system which secures a conductor with excellent contact to a conductive base unit for reliable high current transfer.

A further object of the present invention is to provide an electrical distribution system with an insulated housing for safety, corrosion prevention and long lasting, low loss connection.

Another object of the present invention is to provide an electrical distribution system that has separate holes for receiving cables so that a faulty connection can be easily detected and replaced.

Yet, still another object of the present invention is to provide an electrical distribution system that is plated with a corrosive free element such as gold to provide an aesthetically pleasing show car look.

These and other objects are achieved by the present novel invention which is an electrical distributor including a conductive base unit having a first surface and a first hole extending into the first surface, the first hole having a threaded end adjacent the first surface, and an inwardly tapered portion spaced from the first surface, a compressible conductive sleeve having a central hole and one conical end, the sleeve being fitted into the first hole with the conical end thereof abutting the tapered portion of the first hole, and a bolt threaded in the first hole and for urging the sleeve against the tapered portion and thereby compressing the sleeve, whereby a conductor extending into the first hole and sleeve may be held therein by compressing of the sleeve.

The conductive base unit has a plurality of holes configured similar to the first hole for receiving any desired number of conductors from power supplies or peripheral devices. The sleeve in each hole receives just an exposed conductor end of an insulated cable. The sleeve receives the conductor through a hole at the conical end of the sleeve. Thus, the entire exposed conductor is surrounded and crimped or compressed by the sleeve when the bolt is tightened. This gives a 360 degree crimp around each conductor with excellent contact for reliable current transfer. Since there are separate holes for each insulated conductor, any faulty connection can be easily detected and repaired without tampering with the other connections. This system also makes it easy to replace each or any of the connections.

The base unit has a shoulder means for accepting only the exposed conductor into the sleeve and keeping all other outside elements out of the conical end of the sleeve or tapered portion of the base unit. The insulation on the conductor abuts or flushes against the shoulder within the base unit. There are never any exposed conductors and there is no stripping or fraying of any conductors by the connections. The insulation and the shoulder combine to keep the conductor from being exposed to corrosive elements as well as preventing electrical sparks from flying out of the conductive base unit.

Since gold is a corrosive free element as well as aesthetically pleasing, it can be placed in any car for either a show car look or if just for ease of identifying the distributor within a confusing engine set-up. The entire distributor base unit and connections are covered by an insulated housing. This is especially advantageous due to the constant supply of high power current to the conductive base. The high power conductive base is dangerous if exposed to volatile elements. The housing also keeps the conductive base unit clean and corrosive free. This is especially suitable for motor vehicles since vehicles commonly have a lot of grease and oil spewing around the engines.

DESCRIPTION OF THE DRAWINGS

Further objects and advantages of the invention will appear from the following description as well as from the accompanying drawings which illustrate certain embodiments of the invention. Similar reference numerals refer to similar elements throughout the several views.

DETAILED DESCRIPTION OF THE PRESENT INVENTION

Figure 1:
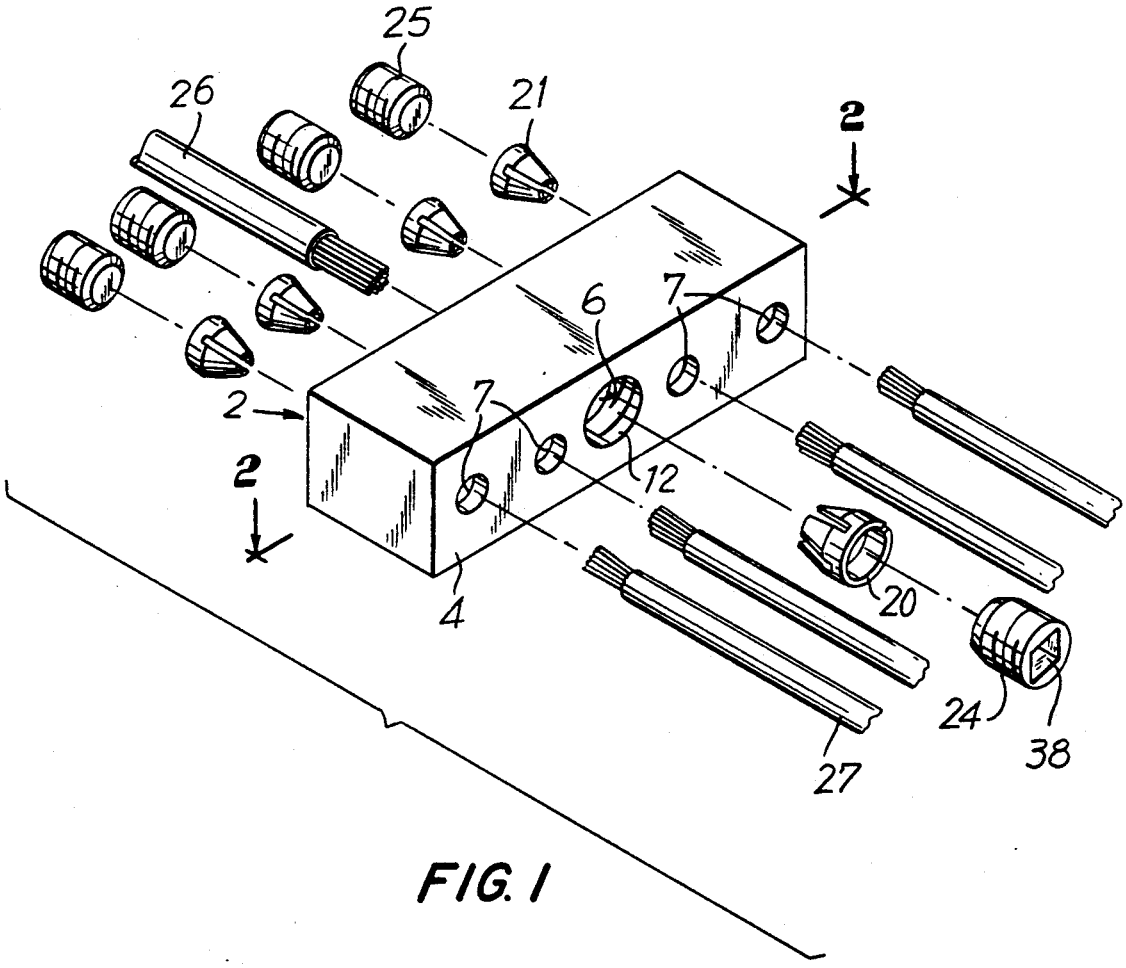
FIG. 1 is an exploded, perspective view of a base unit according to the present invention.
Figure 2:
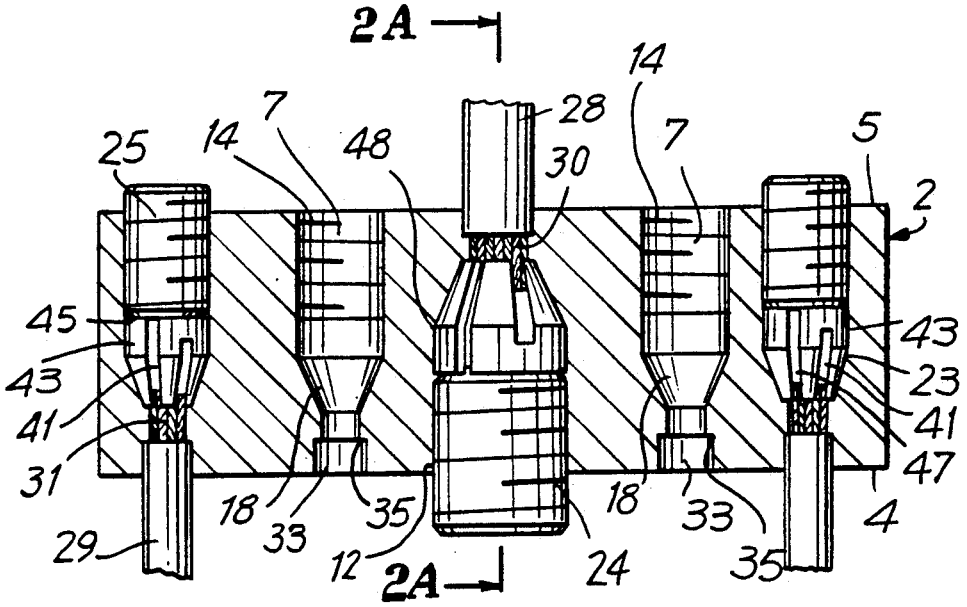
FIG. 2 is a top plan cross-sectional view taken along the line 2A—2A of FIG. 1.

FIG. 1 of the drawings shows an exploded view of the electrical distributor conductive base unit 2 according to a preferred embodiment of the present invention. The conductive base unit 2 is a solid rectangular shaped block. The base unit 2 has a first surface 4 spaced opposite from a second surface 5. A first hole 6 extends into the first surface 4 and out through the second surface 5 as shown in FIG. 2. The first hole 6 has a threaded end 12 adjacent to the first surface 4 for receiving a conventional bolt means 24. The first hole 6 also has an inwardly tapered portion 16 spaced from the first surface 4 beginning at an annular end 48 of the threaded end portion. Thus at approximately half the distance to the second surface from the first surface, the tapered portion 16 begins. Stated differently, the threaded end 12 extends from the first surface 4 approximately half way through the block then flattens out and extends into the inwardly tapered portion 16. All portions have the same concentric middle.

Figure 2A:
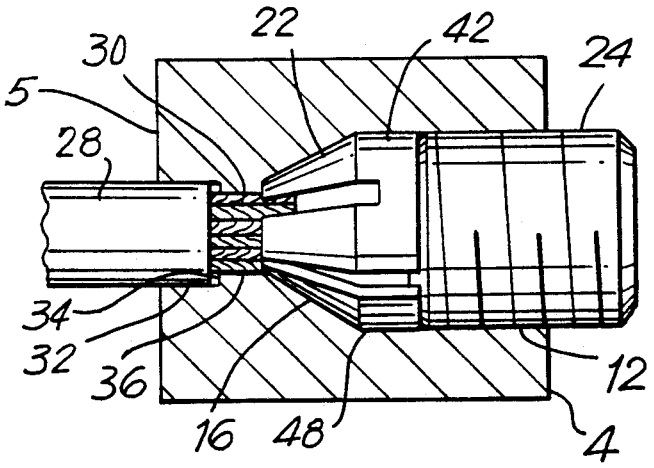
FIG. 2A is a cross-sectional view taken along line 2A—2A of FIG. 2.

At the second surface 5, the first hole has a first portion 32 with a first diameter which is approximately half the size of a diameter of the first hole at the first surface. FIG. 2A shows a shoulder 34 is spaced from the second surface 5 and extends into inwardly tapered portion 16. The shoulder 34 is spaced approximately 1/5 of the distance from the second surface 5. An inner diameter 36 of shoulder is the same diameter as a narrow end of the tapered portion. The shoulder 34 provides the means for preventing insulation 28 on a conductor 30 that is extending into the first portion 32 from extending into the tapered portion 16. The shoulder 34 forms a seat for the insulation 28 on the conductor 30. This prevents anything but the conductor from extending into the tapered portion 16 and sealing the conductor from the outside enviroment. The shoulder ensures that the conductor is isolated from outside elements. Keeping the conductor 30 separated from the outside elements reduces the risk of corrosion or electrical failure.

A separate compressible conductive sleeve 20 having a central hole and one conical end 22 fits into the first hole with the conical end 22 of the sleeve 20 abutting the tapered portion 16 of the first hole 6. The nestable sleeve 20 is concentric with the first hole 6.

Figure 3:
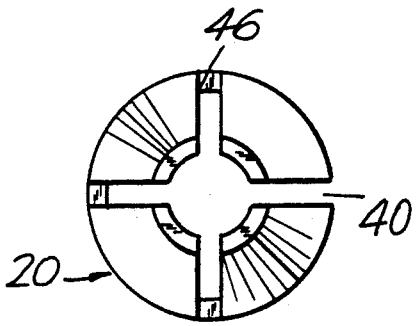
FIG. 3 is a front end view and FIG. 3A a perspective view of a conductive sleeve according to the invention shown in FIG. 1.
Figure 3A:
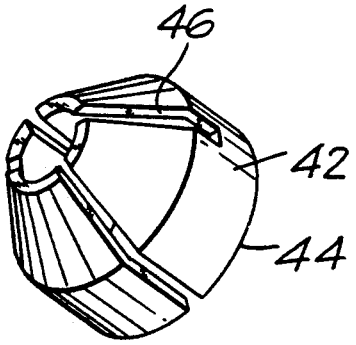

FIG. 3 shows that the sleeve 20 has an annular portion 42 adjacent the conical end 22 and a flat end 44 opposite the conical end 22 for abutting the bolt 24. The bolt 24 is threaded in the first hole 6 and is for urging the sleeve 20 against the tapered portion 16 of the first hole and thereby compressing the sleeve.

The sleeve 20 is compressible because there is a plurality of axially extending slits through sides of the sleeve. There are three slits 46 extending partially through the sleeve from the conical end 22. The partially extending slits 46 extend from a narrow end of the conical end, through the conical end 22 and approximately half way through the annular portion 42 of the sleeve.

The sleeve has a first slit 42 that extends axially all the way through one side. The slit 42 all the way through one side allows the whole sleeve to be compressed as opposed to only the conical end 22 being compressed. There are a total of four slits all equally spaced apart.

In operation, an insulated conductor 26 with the insulation part 28 cut back to expose approximately 3/5" of conductor 30 is pushed into the first hole 6 at the second surface 5. The insulation 28 fits in the first portion 32 but is then stopped from entering into the tapered portion 16 and sleeve 20 the shoulder 34. The insulation 28 flushes or abuts against the shoulder 34 and only the extending conductor passes into the conical end 21 of the sleeve. The bolt 24 is then threaded into the threaded end 12 of the first hole 6 at the first surface 4. The bolt 24 effectively abuts the flat end 44 of the sleeve 22 and thus by tightening the bolt, the sleeve 22 compresses onto the conductor 30. When the sleeve 22 is compressed, the conductor 30 is enclosed and firmly grasped by the sleeve. When the bolt is untightened or loosened. the sleeve thereby loosens its grip on the conductor and the conductor can be removed and/or replaced.

The bolt 24 shown is solid, thus not allowing conductor 26 to extend completely therethrough, with a cavity 38 on an end that is opposite the sleeve 20. The bolt shown is a set screw but a person reasonably skilled in the art may substitute any other suitable bolting means that supplies pressure to the sleeve so that the sleeve is compressed.

The conductor base unit 2 shown, has four smaller holes 7 extending into the second surface 5 and out through the first surface 4. The smaller holes 7 are structured identically to the first hole 6 except proportionally smaller. The smaller holes 7 each have a threaded end 14 adjacent the second surface 5, an inwardly tapered portion 18 spaced from the second surface, a first portion 33 with a respective first diameter at the first surface 4, a smaller shoulder 35 spaced from the first surface and extending to its respective tapered portion. Each smaller shoulder 35 in the smaller holes are also for preventing the insulation 29 on the conductors or any other element besides the conductor 31 itself from extending into the respective tapered portions. Thus, the insulation seats against the shoulder forming a means for sealing the exposed conductor from the outside enviroment. Also, the inner diameter of each shoulder is the same as the diameter of a narrow end of the respective tapered portion.

The smaller holes also each have a respective compressible conductive sleeve 21. Each sleeve has a central hole and one conical end 23. Each sleeve fits into the respective smaller hole with the conical end 23 abutting the tapered portion 18 of the smaller hole 7.

Each smaller hole also has a bolt means for screwing into the threaded end of the smaller holes and for urging the respective sleeves against the tapered portion and thereby compressing the sleeves. The bolt means for each smaller hole does not have a hole extending axially through it. The bolt means shown are solid set screws 25, but any bolt means could be substituted as long as the bolt means urges the respective sleeve against the tapered portion within the respective holes. Set screws 25, being solid, do not allow conductors 27 to extend completely therethrough.

The sleeves of the smaller holes are likewise configured as sleeves of the first hole. Each sleeve has a first slit 41 extending axially through one side for allowing the entire sleeve to be compressed around a conductor extending into the sleeve. There are also three additional axially extending slits 47 extending partially through the sleeve from the conical end. Each sleeve also has an annular portion 43 adjacent its conical end and a flat end 45 opposite the conical end for abutting its respective bolt.

The first hole is for accepting and holding a conductor from a power supply, such as a car battery. The first hole accepts the conductor into its sleeve within the respective tapered portion. The bolt, as it is screwed in, pushes the sleeve further into the tapered portion thereby compressing the sleeve tightly around the conductor. The compressed sleeve provides a 360 degree crimp around the conductor. The conductor from the battery supplies power to the base unit which then acts as a distributor unit. Four smaller conductors are similarly fed into the smaller holes for supplying power from the base unit to other parts of the car such as a radio, power windows, a lighter and any other electrical device that should or can be run from the battery supply. Although described as configured to a battery of a motor vehicle, the electrical distributor of the present invention can be used and configured in numerous ways to adapt to may different types of electrical appliances as well as vehicles.

Figure 4:
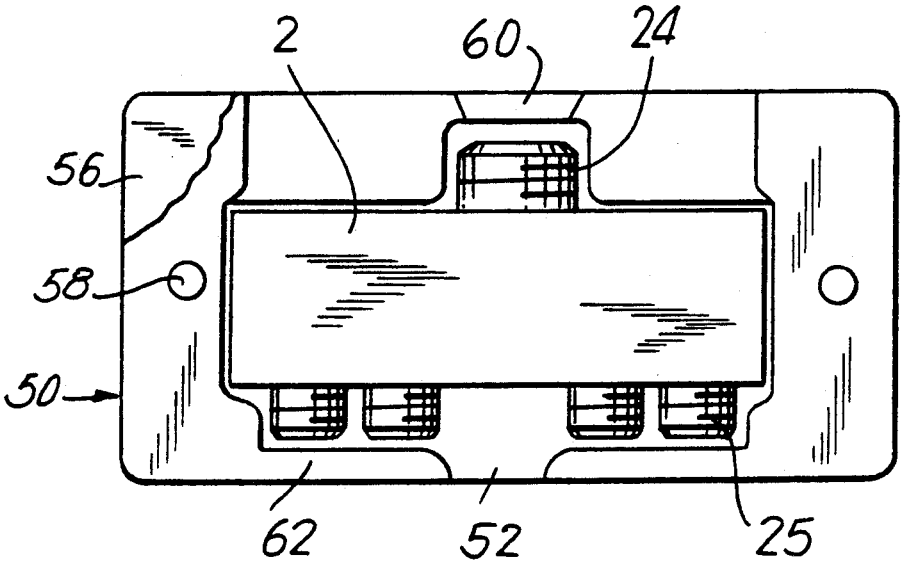
FIG. 4 is a top plan view of the base unit enclosed in an insulated housing according to the invention.
Figure 5:
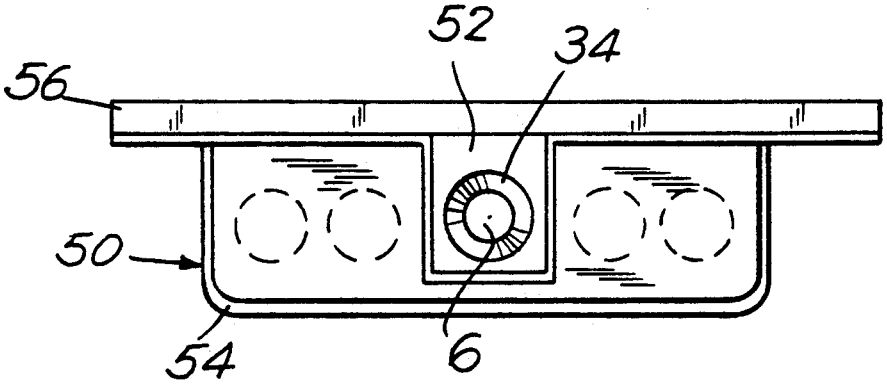
FIG. 5 is a back end view of the base unit enclosed in the housing shown in FIG. 4.
Figure 6:
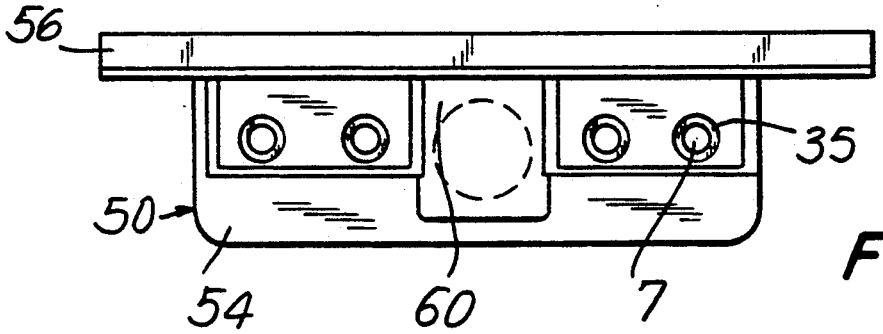
FIG. 6 is a front end view of the base unit enclosed in the housing shown in FIG. 4.

Since the base unit is conductive, it must be safely insulated before it is finally placed within the vehicle or appliance. Thus, an insulating housing 50 is used to surround the base unit. FIGS. 4–6. The housing includes a planar insulating base 54 and an insulating cover 56 mounted on the base by two stand-off screws 58. The housing includes a hole 52 aligned with the first hole at the second surface of the base unit so that an insulated conductor can be received by the base unit. The housing then has a wall 60 aligned with the first hole in the base unit adjacent the first surface of the base unit. The smaller holes also have a second wall 62 aligned with the smaller holes adjacent the second surface. At the first surface the smaller holes are accessible to receiving insulated conductors from outside the housing.

The housing is snugly fit around the entire base unit so that all the bolts have to be tightly fastened or tightly compressing the sleeves in order for the cover and base of the housing to be closed and screwed together. Thus, if there are any loose bolts or conductors the housing can not be closed and a user knows that something is wrong or needs adjustment.

The base unit is composed of a suitable conductive material such as copper, brass, or the like. It may be coated with a corrosive resistant material such as gold, silver or other similar material. The conductors can be composed of copper or any other conductive material in which a relatively large conduction current flows when a potential is applied.

A modification in accordance with the preferred embodiment includes not having the holes go all the way through the base unit. One opening on one surface for each hole, can accommodate the sleeve, the insulated conductor and the bolt means as long as the bolt means also has a hole through it. The conductor would simply extend through the bolt, through the sleeve and into the hole beyond the conical end of the sleeve. The sleeve would then still be tightened on the conductor by way of tightening the bolt.

While the preferred embodiment of the present invention has been shown and described, it will be obvious to one skilled in the art that other modifications, variations, substitutions and alterations may be made thereto without departing from the spirit and scope of the invention, as defined by the appended claims.

What is claimed is:

1. An electrical distributor comprising:

a solid conductive base unit having a first surface and a second surface opposite said first surface, said first surface having a first hole extending into said solid conductive base unit, said first hole having a threaded end adjacent said first surface and an inwardly tapered portion spaced from said threaded end, said second surface having a plurality of holes extending into said second surface, said plurality of holes each having a threaded end adjacent said second surface and an inwardly tapered portion spaced from said threaded end, said first hole and said plurality of holes extending through said first and second surfaces;

a first compressible conductive sleeve having a central hole and one conical end, said sleeve being fitted into said first hole through said first surface with the conical end thereof abutting said tapered portion of said first hole;

a first solid bolt which does not allow a conductor to pass completely therethrough, said first bolt being said first surface for urging said sleeve against said tapered portion and thereby compressing said sleeve;

a first insulated wire conductor having a stripped bare end, said bare end being inserted into said first hole and said conical end of said first sleeve through said second surface and held in said first sleeve by compressing of said sleeve by said solid bolt, said first conductor terminating in said solid conductive base unit;

a plurality of compressible conductive sleeves, each having a central hole, a conical end and a non-conical end, each said sleeve being fitted into a respective one of said holes through said second surface with said conical end thereof abutting the tapered portion of said hole, a plurality of solid bolts, each threaded in a respective hole through said second surface and each not allowing a conductor to pass completely therethrough; and a plurality of insulated conductors having stripped bare ends, each end inserted into a respective said hole at of said first surface, each end also inserted into a respective one of said conical ends of a respective said sleeve, each respective solid bolt of said plurality of solid bolts turning and abutting said non-conical end of said sleeve, and thereby urging said conical end of said respective sleeve into and against said tapered portion and thereby compressing said sleeve and holding said conductor within said respective hole, said plurality of conductors terminating in said solid conductive base unit, said stripped end of said first wire conductor of said plurality of wire conductors removable from said solid base unit without removing any of the other wire conductors; and an insulating housing removably surrounding said base unit, said housing having a edge surface and an opening extending to said edge surface, said opening being adjacent said second surface and aligned with the first hole of said base unit, said base unit being removable from said housing without removing a said conductor from said base unit.

2. The electrical distributor of claim 1, wherein said first hole has a first portion with a first diameter at said second surface and a shoulder spaced from said first portion with a second diameter and extending inwardly to said tapered portion for preventing insulation on a conductor extending into said first portion from extending into said tapered portion.

3. The electrical distributor of claim 2, wherein said second diameter of said shoulder is the same as the diameter of a narrow end of said tapered portion of said first hole.

4. The electrical distributor of claim 3, wherein said first sleeve and said plurality of sleeves each have a first slit extending axially through one side thereof.

5. The electrical distributor of claim 4, wherein said first sleeve and said plurality of sleeves each have an annular portion adjacent the respective said conical end, a flat end opposite said conical end for abutting the respective said bolt, and a plurality of additional axially extending slits extending partially through said sleeve from said conical end.

6. The electrical distributor of claim 5, wherein said plurality of holes are each smaller in diameter than said first hole.

7. The electrical distributor of claim 6, wherein each said hole of said plurality of holes has a respective first portion, proportionately smaller than said first portion of said first hole, each said first portion of said holes of said plurality of holes has a respective first diameter at said first surface, and a smaller shoulder having a second diameter, proportionately smaller than the shoulder of said first hole, spaced from said first portion and extending inwardly to said respective tapered portion for preventing insulation on conductors extending into said first portions from extending into respective tapered portions.

8. The electrical distributor of claim 7, wherein said second diameter of each of said shoulders is the same as the diameter of a narrow end of respective tapered portions of said plurality of holes.

9. The electrical distributor of claim 1, wherein said housing comprises a planar insulating base and an insulating cover mounted on said base, said insulating cover having a planar side parallel to said insulating base, said housing having a wall depending from said planar side and defining said edge, said wall having a portion adjacent said first surface and aligned with said first hole to cover said first bolt.

10. The electrical distributor of claim 1, wherein said housing includes a cover, a first wall aligned with said first hole in said base unit and adjacent said first surface of said base unit and a second wall opposite said first wall, said second wall having holes aligned with the plurality of holes in said first surface of said base unit.

* * * * *